United States Patent [19]

Miwa et al.

[11] 4,455,079

[45] Jun. 19, 1984

[54] IMAGE REPRODUCING APPARATUS

[75] Inventors: Tadashi Miwa, Kunitachi; Kiyoshi Kimura, Iruma; Yukiharu Komiya; Noriyoshi Tarumi, both of Hachioji, all of Japan

[73] Assignee: Konishiroku Photo Industry Co., Ltd., Tokyo, Japan

[21] Appl. No.: 441,795

[22] Filed: Nov. 15, 1982

[30] Foreign Application Priority Data

Nov. 16, 1981 [JP] Japan ..... 56-183456
Nov. 16, 1981 [JP] Japan ..... 56-183457

[51] Int. Cl.[3] ..... G03G 15/16; G03G 15/20
[52] U.S. Cl. ..... 355/3 TR; 355/3 FU
[58] Field of Search ..... 355/3 FU, 3 TR, 3 BE, 355/3 R, 16; 219/216, 388

[56] References Cited

U.S. PATENT DOCUMENTS 3,923,392 12/1975 Buchan et al. ..... 355/3 TR
3,947,113 3/1976 Buchan et al. ..... 355/3 TR
4,095,886 6/1978 Koeleman et al. ..... 355/3 FU
4,183,658 1/1980 Winthaegen ..... 355/16 X
4,187,774 2/1980 Iwasa et al. ..... 355/3 TR
4,341,455 7/1982 Fedder ..... 355/3 TR

*Primary Examiner*—R. L. Moses
*Attorney, Agent, or Firm*—Linda Bierman; Jordan B. Bierman

[57] ABSTRACT

An image reproducing apparatus of the type in which a toner image formed on a charge receptor is transferred to a transfer member and is fixed on said transfer member by the application of pressure and heat by use of an intermediate transfer belt. An auxiliary pressure contact roller is disposed so as to come into contact, via the intermediate transfer belt, with a support roller forming a transfer-fixing portion, disposed inside the intermediate transfer belt and opposing a pressure contact roller via the intermediate transfer belt, so that the contact area between the support roller and the intermediate transfer belt is enlarged.

32 Claims, 12 Drawing Figures

PRIOR ART FIG. 1
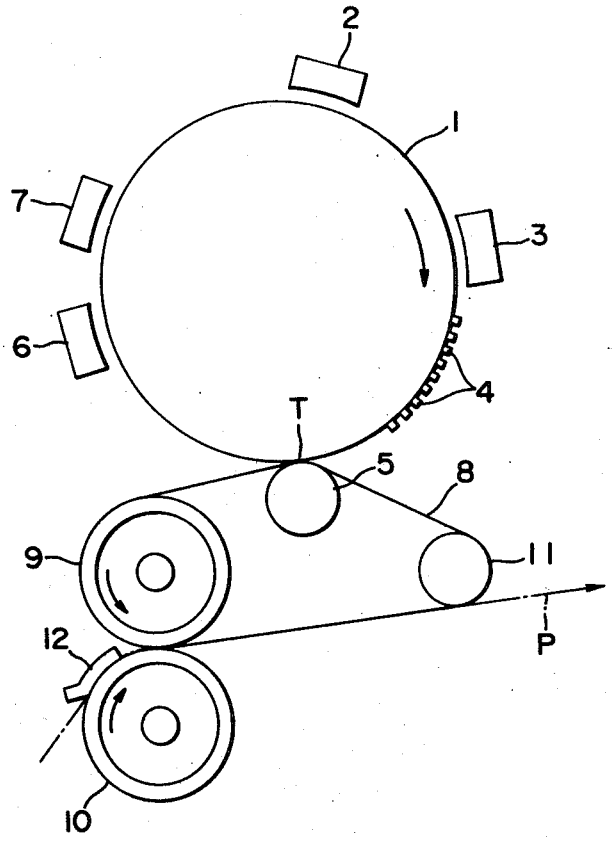

IMAGE REPRODUCING APPARATUS

BACKGROUND OF THE INVENTION

1. Field of the Invention

This invention is concerned with an improvement in or relating to an image reproducing apparatus of the type in which a toner image formed on a charge receptor is transferred and fixed on a transfer member by pressure and heat via an intermediate transfer member.

2. Description of the Prior Art

An image-forming process by a reproducing apparatus such as an electrophotographic reproducing apparatus, for example, comprises the steps of forming an electrostatic latent image corresponding to the image of a document on a charge receptor using an insulating photoconductive material as a photosensitive member by corona discharge and light radiation and developing the latent image into a visible image using a toner developer.

The visible image on the charge receptor or the toner image is transferred onto a transfer member by an electric transfer method such as corona discharge or bias roller or by physical means such as applicaton of pressure or heat. The toner image transferred to the transfer member in the manner described above is fixed on the transfer member by ordinary heating means, completing the image-forming process.

In the image-forming process as described above, an electric method such as a transfer method by corona discharge or a bias roller transfer method is available for transferring the toner image formed on the charge receptor to the transfer member. However, the transfer ratio of this method is significantly affected by the environmental conditions such as the ambient temperature and humidity and turbulence of the transferred image is likely to occur. Accordingly, methods other than the electric method have also been examined and a transfer method by application of pressure is known as one of such methods. According to the disclosure of Japanese Patent Publication No. 41,679/1971 and Japanese Patent Laid-Open No. 78,559/1974, for example, a method and apparatus is known in which the toner image on the photosensitive member is wrapped by an elastic heat-resistant intermediate blanket and is transferred without being permitted to remain on the photosensitive member, thereby ensuring the transfer of the image having good quality.

However, since high speed reproduction is one of the requirements of the times, higher fixing efficiency and a higher fixing speed are also required; hence, various means have been attempted in the reproducing apparatus of the transfer/fixing system by the application of pressure and heat using the intermediate transfer member in order to specifically improve the fixing speed. If the heating temperature of a fixing device is raised in a reproducing apparatus using a belt-like intermediate transfer member so as to enhance the fixing speed, the belt-like intermediate transfer member (hereinafter referred to as the "intermediate transfer belt") is heated especially during repetition of reproduction and the intermediate transfer belt thus heated comes into contact with the charge receptor so that the charge receptor is in turn heated and the properties as the photosensitive member are deteriorated.

As a result of intensive studies, the inventors of the present invention have found that it is possible to escape the heat of the intermediate transfer belt to a support roller and also to an auxiliary pressure contact roller by the construction described below and that better effects can thus be obtained. According to the present invention, the support roller described above is disposed inside the intermediate transfer belt so as to support the latter and the temperature of the support roller, which a heat from said support roller heats and fuses the toner image on the intermediate transfer belt, is not set to a high temperature as in the prior art apparatuses but is set to a low temperature considerably below the fusion temperature of the toner so as to reduce the quantity of heat transfer to the intermediate transfer belt. Furthermore, the surface portion of the support roller after passing through the transfer-fixing portion and the intermediate transfer belt are arranged so as to enlarge the contact area therebetween by use of the auxiliary pressure contact roller described above, thus making it possible to escape the heat of the intermediate transfer belt to the support roller. The auxiliary pressure contact roller is made of a heat absorbing material so that the heat of the intermediate transfer belt can also escape to the auxiliary pressure contact roller, as described above.

SUMMARY OF THE INVENTION

It is therefore an object of the present invention to provide a reproducing apparatus with provides high image quality and has high transfer-fixing speeds by use of an intermediate transfer member having improved thermal influences upon a photosensitive member.

In a reproducing apparatus for transferring a toner image formed on a charge receptor to a transfer member and fixing it thereon by application of pressure and heat using a intermediate transfer belt, the object of the present invention can be accomplished by a reproducing apparatus which is characterized in that an auxiliary pressure contact roller is disposed downstream of a transfer-fixing portion so as to come into contact, via the intermediate transfer belt, with a support roller forming the transfer-fixing portion, disposed inside the intermediate transfer belt and opposing a pressure contact roller via the intermediate transfer belt, so that the contact area between the support roller and the intermediate transfer belt is enlarged.

It is another object of the present invention to provide a reproducing apparatus which has excellent transfer efficiency of a toner image to a transfer member and at the same time, has a hight transfer-fixing speed and which makes use of an intermediate transfer belt having improved thermal influences upon a photosensitive member.

In a reproducing apparatus of the type in which a toner image formed on a charge receptor is transferred to a transfer member and is fixed thereon by the application of pressure and heat by use of an intermediate transfer belt, the object of the present invention described above can be accomplished by a reproducing apparatus which is characterized in that an auxiliary pressure contact roller is disposed downstream of a transfer-fixing portion so as to come into contact, via the intermediate transfer belt, with a support roller forming the transfer-fixing portion, disposed inside the intermediate transfer belt and opposing a pressure contact roller via the intermediate transfer belt, so that the contact area between the support roller, the belt and transfer paper is enlarged and the transfer paper that is discharged from the transfer-fixing portion is inserted between the auxiliary pressure contact roller and the support roller while it is being kept in intimate contact with the intermediate transfer belt.

BRIEF DESCRIPTION OF THE DRAWINGS

FIG. 1 is a schematic view of an example of the conventional reproducing apparatus of the type using the intermediate transfer belt;

DESCRIPTION OF THE PREFERRED EMBODIMENTS

Figure 2A:
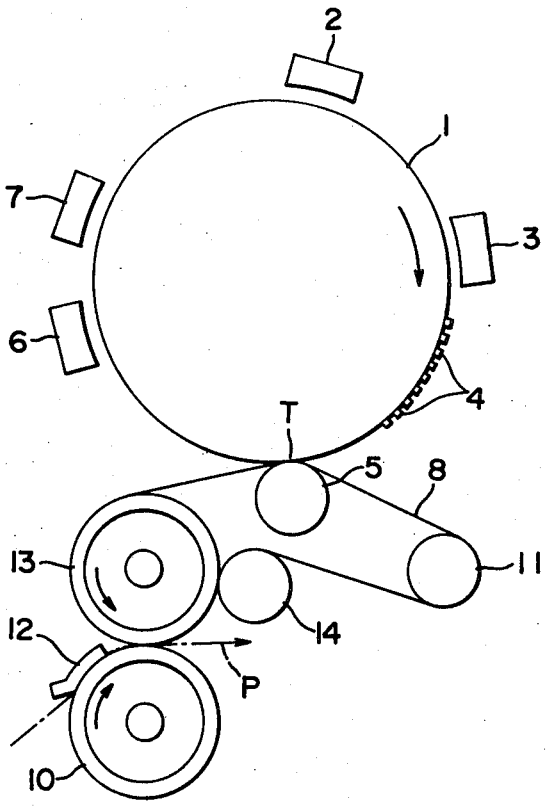
FIGS. 2A and 2B are schematic views of the reproducing apparatus in accordance with preferred embodiments of the present invention.

Hereinafter, preferred embodiments of the present invention will be described with reference to the accompanying drawings.

FIG. 1 is a schematic view showing an example of the conventional reproducing apparatus. In the drawing, reference numeral 1 represents a drum-like charge receptor that can rotate in the direction indicated by an arrow. An electrostatic latent image-forming portion 2, a developing device 3, a transfer pressure roller 5, a cleaning device 6 and a charge eliminater 7 are sequentially disposed around the outer circumference of the charge receptor 1 in its rotating direction in order named. Reference numeral 4 represents a toner image formed on the charge receptor 1. If the charge receptor 1 is made of a photoconductive photosensitive material, the electrostatic latent image-forming portion 2 consists of a charger and an exposure optical system and if the charge receptor 1 is made of a dielectric, it is composed by multistylus electrodes or ion stream modulation electrodes.

The electrostatic latent image formed by the electrostatic image-forming portion 2 is developed by the developing device into the toner image 4 and reaches the transfer portion T as the charge receptor 1 rotates.

Reference numeral 8 represents a belt-like intermediate transfer member (hereinafter referred to as the "intermediate transfer belt") that is wound around the transfer pressure roller 5 and the like. This belt consists of a transer layer made of a heat-resistant flexible member such as silicone type rubber or Teflon type rubber and a laminate of a heat-resistant base such as stainless steel and a heat-resistant polymer film of resins such as polyimide, polyimide amide, polyamide, polyester, polyacrylate and the like (e.g. "U sheet", a product of Taihei Kagaku Co.). Silicone type rubber of room temperature vulcanization or low temperature vulcanization type is especially preferred as the material of the transfer layer. For example, "LTV1300" and "LTV1800" (products of Shin-etsu Kagaku Kogyo Co.) are silicone rubber of an addition polymerization type and are especially preferred as the material of the transfer layer.

Along with rotation of the charge receptor 1, the toner image 4 is carried to the transfer portion T, and is pressed and transferred by the transfer pressure roller 5 to the transfer layer of the flexible material on the intermediate transfer belt 8 in such a manner as to adhere to the transfer layer.

Reference numeral 9 represents a heating roller equipped with a built-in heat source while reference numeral 10 does a pressure contact roller that comes into pressure contact with the heating roller 9 via the intermediate transfer belt 8. Reference numeral 11 represents a conveyor roller driven by a driving source not shown. The intermediate transfer belt 8 is turnably spread around the transfer pressure roller 5, the heating roller 9 and the conveyor roller 11.

Reference numeral 12 represents a heater for the transfer paper and may be disposed, whenever necessary. The pressure contact roller 10 may be used as the heating roller with a built-in heat source, whenever necessary.

As the belt rotates, the toner image transferred onto the intermediate transfer belt 8 moves to the transfer-fixing portion while being heated by the heating roler 9, is then brought into pressure contact with transfer paper P which is conveyed by the heating roller 9 and the pressure contact roller 10 from a paper feeder (not shown) and which is preferably heated sufficiently by a paper heater 12, whenever necessary, and is thereafter transferred to and fixed on the transfer paper P.

In accordance with the conventional reproducing apparatus described above, the toner image of the intermediate transfer belt 8 is fused and fixed substantially completely on the transfer paper P. When continuous reproduction is effected, however, the intermediate transfer belt 8 after the fixing operation reaches a considerably high temperature and is likely to come into pressure contact with the charge receptor 1 while holding the heat before it is sufficiently cooled. Accordingly, the charge receptor 1 is thermally affected by the heat and the characteristic properties drop or change so that the reproduced image having high quality can not be obtained.

FIG. 2A is a schematic view of the reproducing apparatus in accordance with one embodiment of the present invention.

In the drawing, reference numeral 13 represents a support roller that comes into contact with the intermediate transfer belt 8 and forms the transfer-fixing portion. Reference numeral 14 represents an auxiliary pressure contact roller that is disposed at the position where it comes into pressure contact with the support roller 13. The present invention is characterized in that the auxiliary pressure contact roller 14 is disposed so as to increase the contact area of the intermediate transfer belt 8 with the support roller 13.

The present invention will be described in further detail with the embodiment shown in FIG. 2A.

As the belt rotates, the toner image transferred to the intermediate transfer belt 8 by the pressure of the transfer pressure roller 5 is carried to the transfer-fixing portion while being suitably heated, is laminated with the transfer paper P which is heated to a temperature above the toner fusion temperature by the paper heater 12 or the pressure contact roller 10, is sufficiently heated and at the same time, receives the pressure by the support roller 13 and the pressure contact roller 10 and is transferred to and fixed on the transfer paper P. In this embodiment, the temperature of the support roller 13 is set to a temperature considerably lower than the toner fusion temperature. As the transfer paper P for supporting the fused toner image passes by the pressure contact point between the support roller 13 and the pressure contact roller 10, it is separated from the intermediate transfer belt 8 and is stored in a paper discharging device (not shown).

On the other hand, the intermediate transfer belt 8 that receives the heat moves while keeping pressure contact with the support roller 13 and reaches the pressure contact point between the support roller 13 and the auxiliary pressure contact roller 14. However, as described above, the support roller 13 is set from the beginning at a temperature lower than the toner fusion temperature. For this reason, the intermediate transfer belt 8 is deprived of its heat by the support roller 13 during its pressure contact with the latter, and gradually loses its heat. When it again reaches the position where it comes into pressure contact with the charge receptor 1, the intermediate transfer belt 8 is cooled down to such an extent that it can no longer thermally deteriorate the properties of the charge receptor 1. In accordance with the present invention, therefore, the thermal influences of the intermediate transfer belt upon the charge receptor can be prevented and hence, a reproduced image having high quality can always be obtained.

Figure 3A:
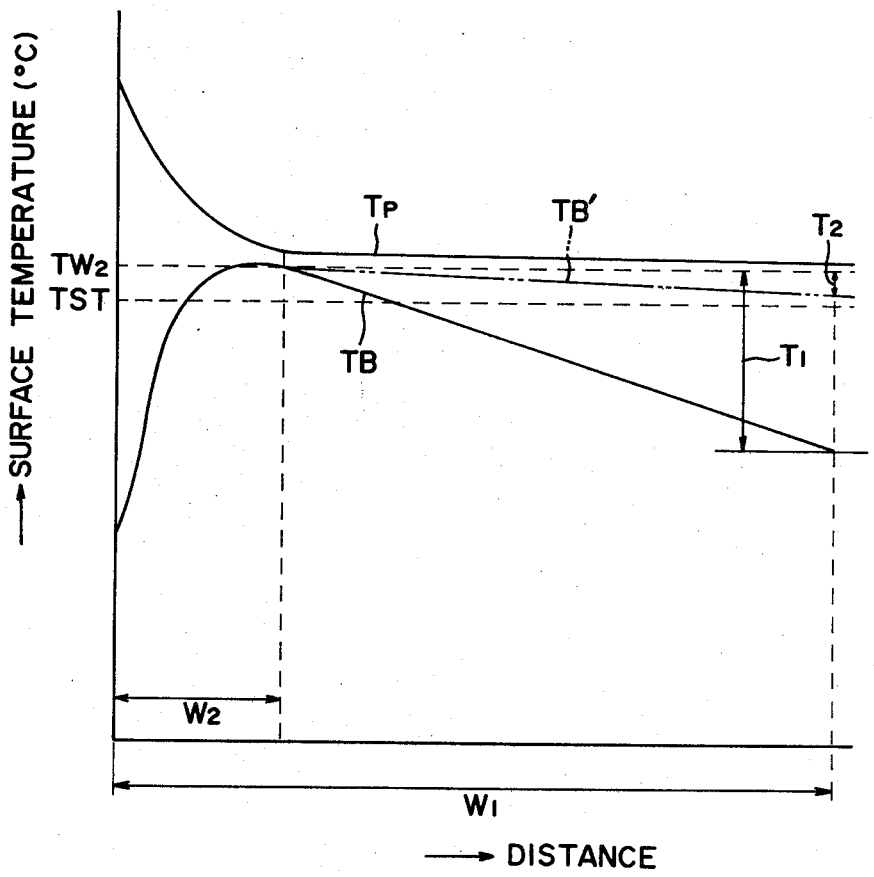
FIGS. 3A and 3B are diagrams showing the surface temperature of the intermediate transfer belt in the reproducing apparatus of the present invention in comparison with that of the intermediate transfer belt in the conventional reproducing apparatus.

FIG. 3A diagrammatically shows the change of surface temperature of the intermediate transfer belt and that of the transfer paper in the conventional reproducing apparatus in comparison with those of the reproducing apparatus of the present invention. The diagram is based upon the assumption that the surface temperature of the transfer paper or the intermediate transfer belt during transfer and fixing is the same both in the conventional apparatus and in the present apparatus. In the diagram, symbols TB and TB' represent the surface temperature of the intermediate transfer belt in the present apparatus and conventional apparatus, respectively, and symbol TP represents the surface temperature of the transfer paper in the apparatus of the present invention. Symbol TST represents the toner fusion temperature, $W_2$ represents the nip width by the support roller and the pressure contact roller and $W_1$ represents the distance in which the belt starts being pressed by the pressure contact roller and leaves the support roller.

As shown in the diagram, when the transfer paper P is heated by the paper heater to a temperature above the toner fusion temperature and is pressed on the intermediate transfer belt at the transfer fixing portion, the transfer paper P heats the intermediate transfer belt 8 to a temperature suitable for fixing. After the transfer and fixing of the toner image are effected, the transfer paper P is separated and only the intermediate transfer belt 8 moves while keeping pressure contact with the support roller 13. During this pressure contact period, heat transfer occurs from the intermediate transfer belt 8 to the support roller 13 of the present invention which is set to a relatively low temperature and the intermediate transfer belt 8 gradually loses its heat (TB temperature). In consequence, by the time when the intermediate transfer belt 8 is separated from the support roller 13, the temperature of the intermediate transfer belt 8 in the present invention can be remarkably reduced as represented by $T_1-T_2$ in comparison with the temperature TB' (represented by two-dot chain line) of the intermediate transfer member in the conventional apparatus. Here, the temperature $T_1$ means the difference between the surface temperature of the intermediate transfer belt at the point of the nip width $W_2$ where it leaves the pressure contact roller in the present invention and the surface temperature at the distance $W_1$ where it leaves the support roller and $T_2$ means likewise the difference of the surface temperatures in the intermediate transfer belt in the conventional reproducing apparatus.

In the embodiment shown in FIG. 2A, the toner fusion temperature, the temperature of the support roller, that of the pressure contact roller and the temperature of the transfer paper immediately before the transfer are 130° C., 90° C., 200° C. and 140° C., respectively. However, these values are merely illustrative and different temperature values can be used depending upon the construction of the apparatus.

Figure 2B:
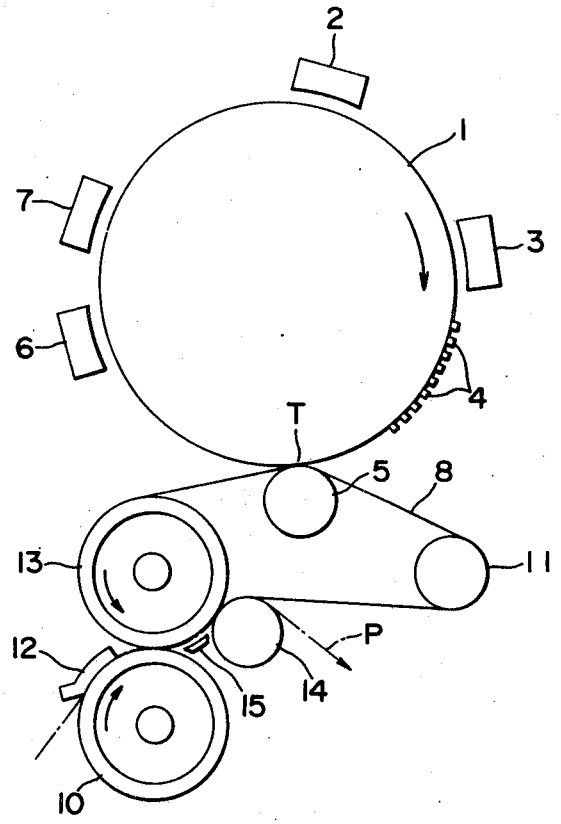

FIG. 2B shows a schematic view of another embodiment of the reperoducing apparatus according to the present invention.

Reference numeral 15 represents a conveyor guide for conveying the transfer paper P, that is discharged from the transfer-fixing portion, while keeping it in contact with the intermediate transfer belt 8.

Since the conveyor guide 15 is also disposed together with the auxiliary pressure contact roller 14 as described above, this embodiment has the structural feature that the contact area of the intermediate transfer belt 8 and the transfer paper P with respect to the support roller 13 is enlarged.

In the embodiment described above, the temperature of the intermediate transfer belt 8 and that of the transfer paper P when they pass through the transfer-fixing portion consisting of the support roller 13 and the pressure contact roller 10 are the same as those in the conventional reproducing apparatus. In the embodiment of the present invention, however, the transfer paper P supporting thereon the toner image is conveyed together with the belt by the conveyor guide 15 and as they pass between the support roller 13 and the auxiliary pressure contact roller 14 while being kept in intimate contact with the intermediate transfer belt 8, the heat inflows from the transfer paper P, the intermediate transfer belt 8 and the toner to the support roller 13 and the auxiliary pressure contact roller 14. After the temperatures of the transfer paper P, intermediate transfer belt and toner are thus reduced sufficiently, the intermediate transfer belt 8 and the transfer paper are separated from each other so that the toner viscosity at the time of separation can be made sufficiently large or the toner can be brought into the solid state. In consequence, the present invention provides the effect that a so-called "off-set phenomenon", in which the fused toner remains and attaches to the intermediate transfer belt 8, can be prevented and transfer and fixing can be effected smoothly. Since the contact area of the intermediate transfer belt and the transfer paper with respect to the support roller 13 are enlarged, the transfer efficiency of the toner to the transfer paper can be improved.

Figure 3B:
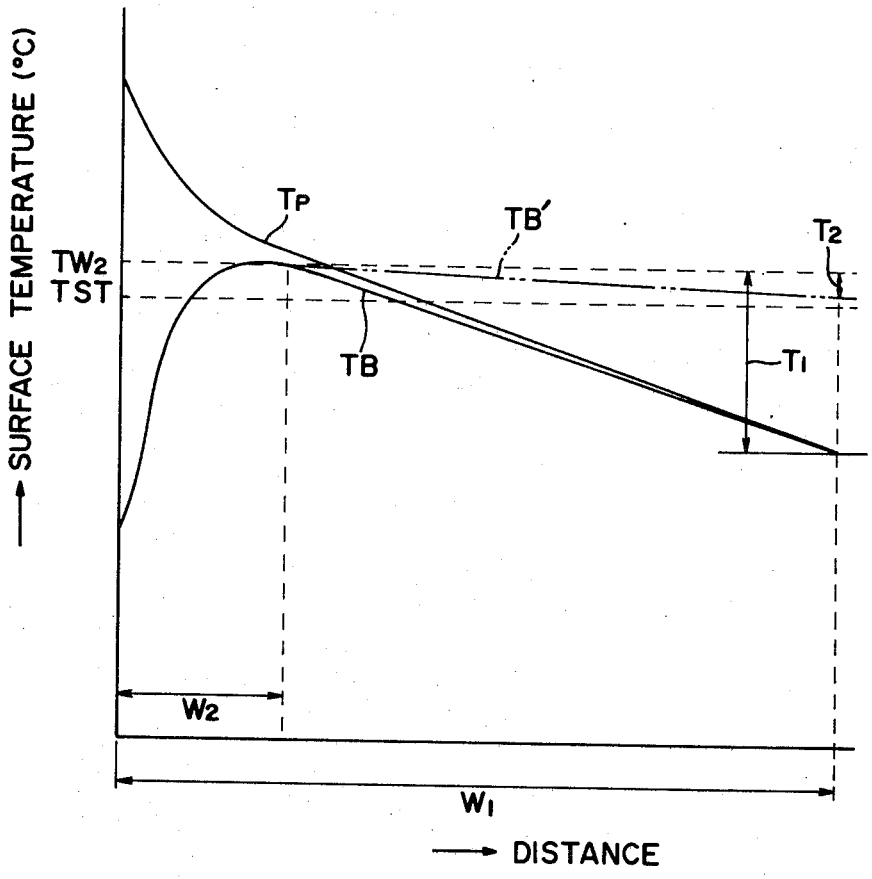

FIG. 3B shows the change of temperature of the intermediate transfer belt and transfer paper in the apparatus of the present invention in comparison with those in the conventional reproducing apparatus.

As shown by a curve Tp in FIG. 3B, the transfer paper rapidly loses the heat along with the temperature drop of the intermediate transfer belt laminated with the transfer paper and the temperature of the toner image that has been transferred and fixed also drops. The toner layer changes to the solid state and to the highly viscous state and forms a strong and stiff layer. After passing through the pressure contact point with the auxiliary pressure contact roller, the transfer paper is then peeled and separated from the belt.

Figure 4A:
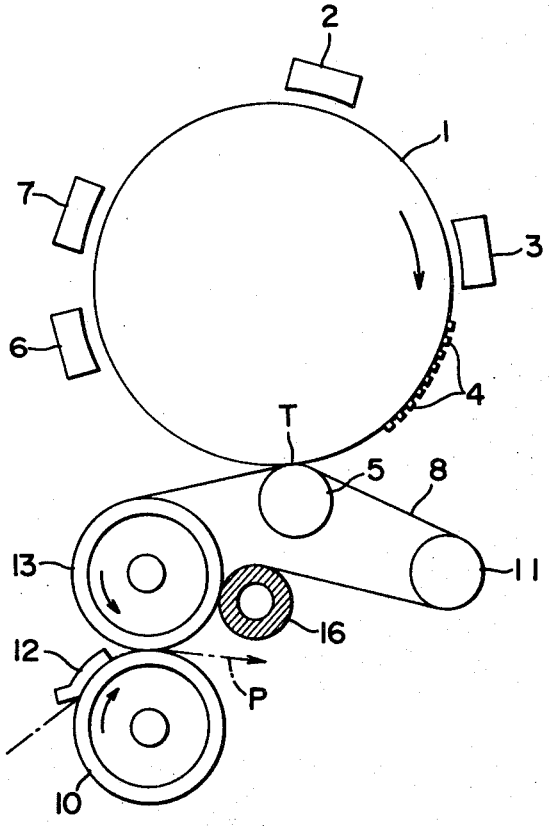
FIGS. 4A, 4B, 5A, 5B, 6, 7A and 7B are schematic views of other preferred embodiments of the present invention.
Figure 4B:
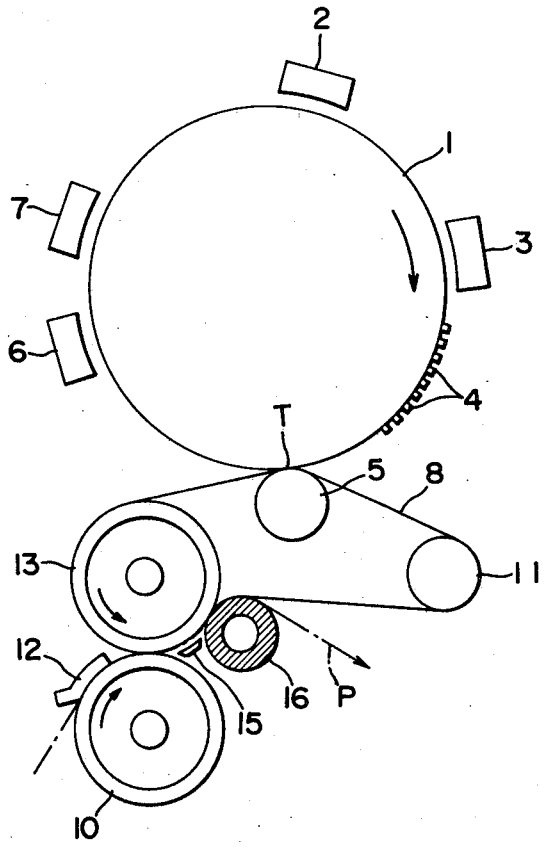

FIGS. 4A and 4B show another embodiment of the present invention. This embodiment uses a heat pipe roller 16 having a higher heat transfer efficiency as the auxiliary pressure contact roller 14 shown in FIGS. 2A and 2B in order to more effectively accomplish the objects of the present invention. Any of the heretofore known materials may be used as the heat pipe roller 16 so long as they have a high heat transfer efficiency. In this embodiment, the heat pipe roller is turnably disposed as the auxiliary pressure contact roller itself, but it is also possible to fix the heat pipe roller and to turnably dispose another roller that is closely related thermally with the heat pipe roller in order to form the auxiliary pressure contact roller. A heat pipe roller consisting of aluminum having a high heat transfer property is generally used, for example. Needless to say, one end of the heat pipe roller 16 is integrated with a cooling fin that is disposed inside a low temperature space so as to be spaced apart from the transfer-fixing portion. Since the auxiliary pressure contact roller is thus kept at a low temperature, the temperature gradient inside the support roller, the intermediate transfer belt and the auxiliary pressure contact roller becomes such that the heat flows from the support roller to the auxiliary pressure contact roller.

Figure 5A:
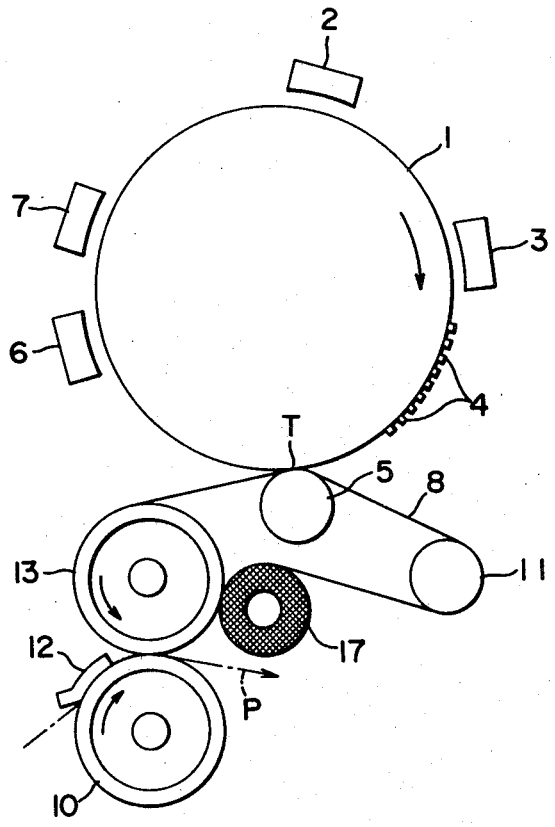
Figure 5B:
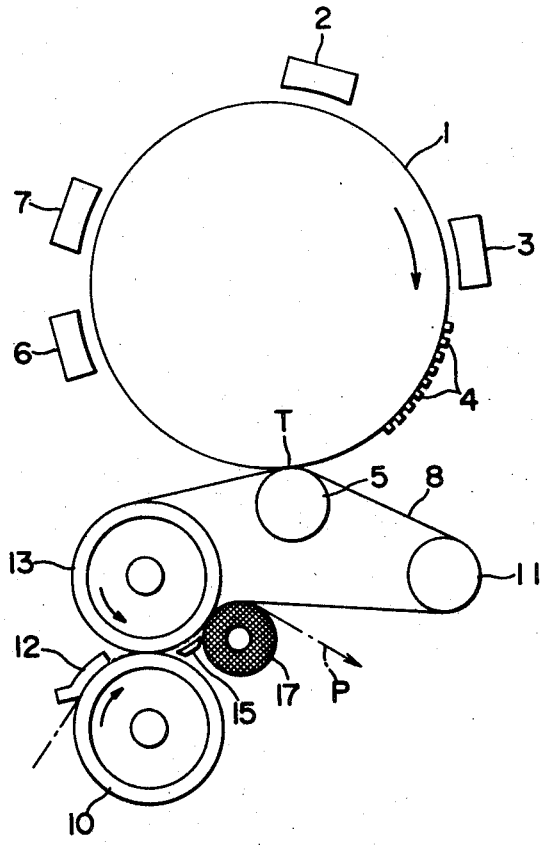

FIGS. 5A and 5B show still another embodiment of the present invention. This embodiment also uses a roller having high heat absorbing efficiency or high heat capacity as the auxiliary pressure contact roller, such as a roller 17 made of iron, for example.

Figure 6:
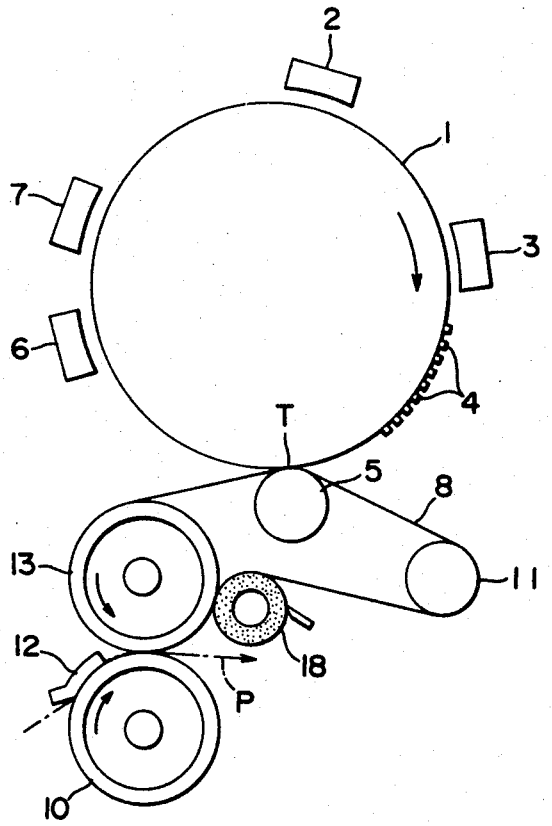

FIG. 6 shows still another embodiment of the present invention. This embodiment illustrates an apparatus using a roller 18 having a cleaning function, for example, as the auxiliary pressure contact roller 14. It is of course preferred to form the auxiliary pressure contact roller having such a cleaning function by a material having high heat absorbing property, in order to effectively cool the belt. It is also preferred that the reproducing apparatus in accordance with the present invention uses the auxiliary pressure contact roller having not only the heat absorbing effect but also other action and effect such as described above.

Figure 7A:
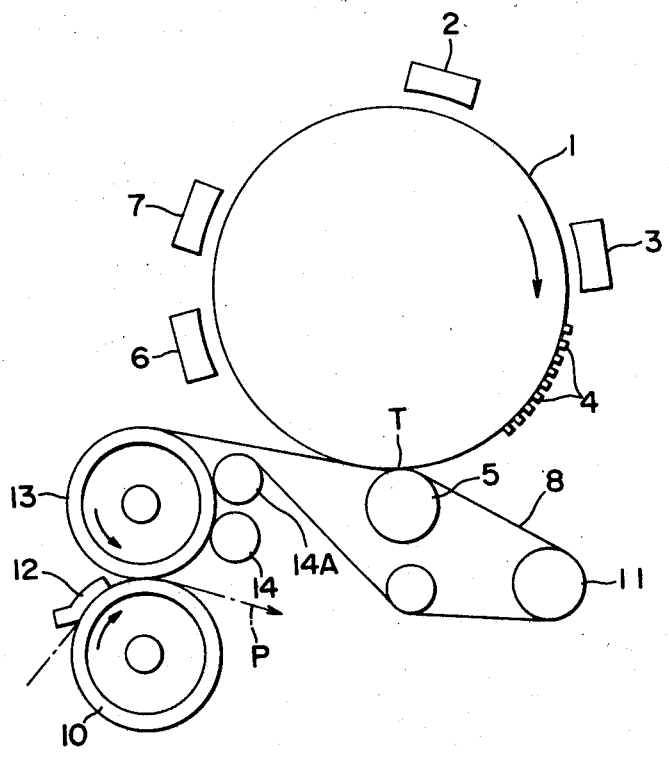
Figure 7B:
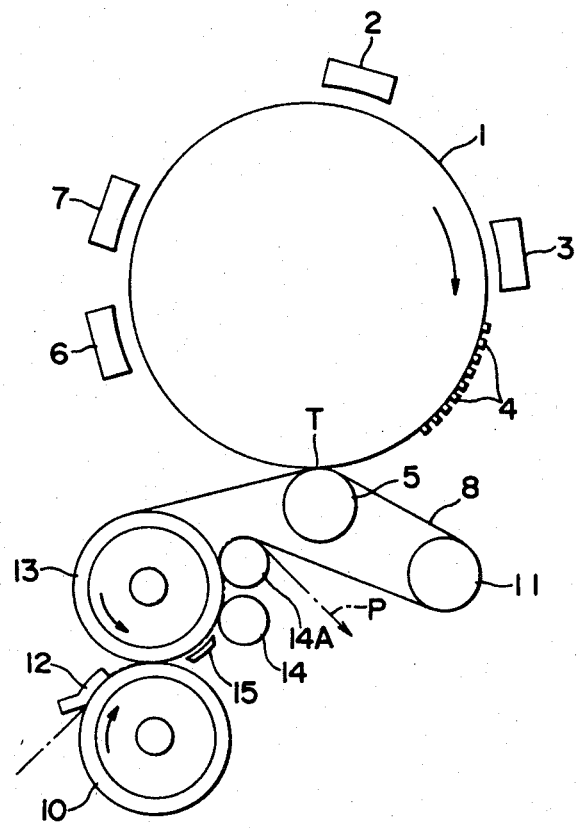

A silicone rubber roller is used as the cleaning roller, for example. It is preferred for the present invention to use a plurality of auxiliary pressure contact rollers such as the rollers 14 and 14A shown in FIGS. 7A and 7B in order to improve the contact condition of the intermediate transfer belt with respect to the support roller as much as possible.

As described in detail in the foregoing, in the reproducing apparatus of the present invention, the auxiliary pressure contact roller is disposed so as to enlarge the contact area between the support roller and the intermediate transfer belt, and the support roller can absorb the heat of the transfer belt by setting the temperature of the support roller below the toner fusion temperature. It is also possible to escape the heat of the intermediate transfer belt to the auxiliary pressure contact roller by use of a roller having high heat conductivity or a roller having a large heat capacity as the auxiliary pressure contact roller. Accordingly, a reproducing apparatus can be obtained which necessarily has improved heat allowance and higher fixing speed and in which the thermal influences of the belt upon the charge receptor are eliminated.

In the drawings illustrating the preferred embodiments of the present invention, the transfer pressure roller for bringing the intermediate transfer belt into pressure contact with the charge receptor and the conveyor roller for driving the belt are shown disposed separately from each other, but they can be replaced by a single roller. It is also possible to employ such a system in which a driving source is disposed so as to rotate either the support roller or the pressure contact roller and the other follows up the rotation of the former. However, they must be rotated in synchronism with the charge receptor. The reproducing apparatus in accordance with the present invention can be preferably applied to a retention process.

What is claimed is:

1. In an image reproducing apparatus of the type in which a toner image formed on a charge receptor is transferred to a transfer member and is fixed on said transfer member by the application of pressure and heat by use of an intermediate transfer belt, the improvement wherein an auxiliary pressure contact roller is disposed downstream of a transfer-fixing portion so as to come into contact, via said intermediate transfer belt, with a support roller forming said transfer-fixing portion, disposed inside said intermediate transfer belt and opposing a pressure contact roller via said intermediate transfer belt, so that the contact area between said support roller and said intermediate transfer belt is enlarged.

2. The image reproducing apparatus as defined in claim 1 wherein said support roller is kept at a temperature lower than the fusion temperature of the toner of said toner image and at least one of said transfer member to be introduced into said transfer-fixing portion and said pressure contact roller is kept at a temperature higher than the fusion temperature of said toner.

3. The image reproducing apparatus as defined in claim 1, wherein a roller having high heat conductivity and having cooling means is used as said auxiliary pressure contact roller.

4. The image reproducing apparatus as defined in claim 1, wherein a roller consisting of a heat pipe is used as said auxiliary pressure contact roller.

5. The image reproducing apparatus as defined in claim 1, wherein a cleaning roller is used as said auxiliary pressure contact roller.

6. The image reproducing apparatus as defined in claim 1, which uses a plurality of said auxiliary pressure contact rollers.

7. The image reproducing apparatus as defined in claim 2, wherein a roller having high heat conductivity and having cooling means is used as said auxiliary pressure contact roller.

8. The image reproducing apparatus as defined in claim 2, wherein a roller consisting of a heat pipe is used as said auxiliary pressure contact roller.

9. The image reproducing apparatus as defined in claim 2, wherein a cleaning roller is used as said auxiliary pressure contact roller.

10. The image reproducing apparatus as defined in claim 2, which uses a plurality of said auxiliary pressure contact rollers.

11. The image reproducing apparatus as defined in claim 3, which uses a plurality of said auxiliary pressure contact rollers.

12. The image reproducing apparatus as defined in claim 7, which uses a plurality of said auxiliary pressure contact rollers.

13. The image reproducing apparatus as defined in claim 5, which uses a plurality of said auxiliary pressure contact rollers.

14. The image reproducing apparatus as defined in claim 8, which uses a plurality of said auxiliary pressure contact rollers.

15. The image reproducing apparatus as defined in claim 5, which uses a plurality of said auxiliary pressure contact rollers.

16. The image reproducing apparatus as defined in claim 9, which uses a plurality of said auxiliary pressure contact rollers.

17. In an image reproducing apparatus of the type in which a toner image formed on a charge receptor is transferred to a transfer member and is fixed on said transfer member by the application of pressure and heat by use of an intermediate transfer belt, the improvement wherein an auxiliary pressure contact roller is disposed downstream of a transfer-fixing portion so as to come into contact, via said intermediate transfer belt, with a support roller forming said transfer-fixing portion, disposed inside said intermediate transfer belt and opposing a pressure contact roller via said intermediate transfer belt, so that the contact area between said support roller, said belt and transfer paper is enlarged and said transfer paper that is discharged from said transfer-fixing portion is inserted between said auxiliary pressure contact roller and said support roller while said transfer paper is being kept in intimate contact with said intermediate transfer belt.

18. The image reproducing apparatus as defined in claim 17, wherein said support roller is kept at a temperature lower than the fusion temperature of the toner of said toner image and at least one of said transfer member to be introduced into said transfer-fixing portion and said pressure contact roller is kept at a temperature higher than the fusion temperature of said toner.

19. The image reproducing apparatus as defined in claim 17, wherein a roller having high heat conductivity and having cooling means is used as said auxiliary pressure contact roller.

20. The image reproducing apparatus as defined in claim 18, wherein a roller having high heat conductivity and having cooling means is used as said auxiliary pressure contact roller.

21. The image reproducing apparatus as defined in claim 17, wherein a roller consisting of a heat pipe is used as said auxiliary pressure contact roller.

22. The image reproducing apparatus as defined in claim 18, wherein a roller consisting of a heat pipe is used as said auxiliary pressure contact roller.

23. The image reproducing apparatus as defined in claim 17, wherein a cleaning roller is used as said auxiliary pressure contact roller.

24. The image reproducing apparatus as defined in claim 19, wherein a cleaning roller is used as said auxiliary pressure contact roller.

25. The image reproducing apparatus as defined in claim 17, which uses a plurality of said auxiliary pressure contact rollers.

26. The image reproducing apparatus as defined in claim 18, which uses a plurality of said auxiliary pressure contact rollers.

27. The image reproducing apparatus as defined in claim 19, which uses a plurality of said auxiliary pressure contact rollers.

28. The image reproducing apparatus as defined in claim 20, which uses a plurality of said auxiliary pressure contact rollers.

29. The image reproducing apparatus as defined in claim 21, which uses a plurality of said auxiliary pressure contact rollers.

30. The image reproducing apparatus as defined in claim 22, which uses a plurality of said auxiliary pressure contact rollers.

31. The image reproducing apparatus as defined in claim 23, which uses a plurality of said auxiliary pressure contact rollers.

32. The image reproducing apparatus as defined in claim 24, which uses a plurality of said auxiliary pressure contact rollers.

* * * * *